US011815300B2

(12) United States Patent
Kang et al.

(10) Patent No.: US 11,815,300 B2
(45) Date of Patent: Nov. 14, 2023

(54) CHILLER SYSTEM AND A METHOD FOR GENERATING COORDINATION MAPS FOR ENERGY EFFICIENT CHILLED WATER AND CONDENSER WATER TEMPERATURE RESETS IN CHILLER PLANT SYSTEM

(71) Applicant: CARRIER CORPORATION, Palm Beach Gardens, FL (US)

(72) Inventors: Keunmo Kang, San Diego, CA (US); Lina Yang, Shanghai (CN); Xinyu Wu, Shanghai (CN); Sheng Li, Shanghai (CN)

(73) Assignee: CARRIER CORPORATION, Palm Beach Gardens, FL (US)

( * ) Notice: Subject to any disclaimer, the term of this patent is extended or adjusted under 35 U.S.C. 154(b) by 349 days.

(21) Appl. No.: 15/734,899

(22) PCT Filed: Jul. 8, 2019

(86) PCT No.: PCT/US2019/040755
§ 371 (c)(1),
(2) Date: Dec. 3, 2020

(87) PCT Pub. No.: WO2020/018299
PCT Pub. Date: Jan. 23, 2020

(65) Prior Publication Data

US 2021/0222928 A1 Jul. 22, 2021

(30) Foreign Application Priority Data

Jul. 16, 2018 (CN) ..... 201810780693.9

(51) Int. Cl.
*F25B 49/02* (2006.01)
*F25B 1/047* (2006.01)

(52) U.S. Cl.
CPC ..... *F25B 49/02* (2013.01); *F25B 1/047* (2013.01); *F25B 2339/047* (2013.01);
(Continued)

(58) Field of Classification Search
CPC ..... F25B 1/047; F25B 2339/047; F25B 2400/06; F25B 25/005; F25B 2700/21161;
(Continued)

(56) References Cited

U.S. PATENT DOCUMENTS 4,474,027 A 10/1984 Kaya et al.
5,963,458 A 10/1999 Cascia
(Continued)

FOREIGN PATENT DOCUMENTS

CN 101581491 B 6/2012
CN 103968509 A 8/2014
(Continued)

OTHER PUBLICATIONS

International Preliminary Report on Patentability for International Application No. PCT/US2019/040755; International Filing Date: Jul. 8, 2019; dated Jan. 19, 2021; 6 pages.
(Continued)

*Primary Examiner* — Henry T Crenshaw
(74) *Attorney, Agent, or Firm* — CANTOR COLBURN LLP

(57) ABSTRACT

Techniques for generating coordination maps for energy efficient chilled water and condenser water temperature resets in a chiller plant system. A controller is configured to control and set thresholds for one or more parameters of the chiller system, the chiller system includes one or more cooling tower, one or more pumps, and one or more water chillers, and one or more sensors operably coupled to the controller, the one or more sensors are configured to measure
(Continued)

values for one or more parameters. A processor is coupled to the controller, the processor is configured to generate a coordination map based on the measured values and the thresholds for the one or more parameters, configure an operating setpoint for the chiller system based on the coordination map, and control the chiller system based at least in part on the configured operating setpoint.

14 Claims, 5 Drawing Sheets

(52) U.S. Cl.
CPC . *F25B 2400/06* (2013.01); *F25B 2700/21161* (2013.01); *F25B 2700/21172* (2013.01); *F25B 2700/21173* (2013.01)

(58) Field of Classification Search
CPC .. F25B 2700/21172; F25B 2700/21173; F25B 49/02
See application file for complete search history.

(56) References Cited

U.S. PATENT DOCUMENTS

| | | | | |
|---|---|---|---|---|
| 8,406,929 | B2 | 3/2013 | Duncan | |
| 8,880,226 | B2 | 11/2014 | Raman et al. | |
| 9,278,142 | B1 | 3/2016 | Goodnow | |
| 9,423,172 | B2 | 8/2016 | Wong et al. | |
| 9,696,054 | B2 | 7/2017 | Asmus | |
| 2009/0171512 | A1* | 7/2009 | Duncan | F24F 11/30 62/157 |
| 2011/0276180 | A1* | 11/2011 | Seem | G05B 13/0265 700/32 |
| 2014/0229146 | A1 | 8/2014 | Gonzalez et al. | |
| 2015/0052919 | A1* | 2/2015 | McGowan | F25B 49/005 62/118 |
| 2015/0354849 | A1* | 12/2015 | Matsuo | F25B 25/005 62/181 |
| 2017/0241657 | A1 | 8/2017 | Salsbury et al. | |
| 2017/0241658 | A1 | 8/2017 | Salsbury et al. | |
| 2017/0363337 | A1 | 12/2017 | Swofford et al. | |
| 2018/0306459 | A1* | 10/2018 | Turney | G05B 13/048 |
| 2018/0372362 | A1* | 12/2018 | Turney | H02J 3/14 |

FOREIGN PATENT DOCUMENTS

| | | | |
|---|---|---|---|
| CN | 105650808 | A | 6/2016 |
| EP | 2322877 | A2 | 5/2011 |
| EP | 2330365 | A2 | 6/2011 |
| GB | 2191021 | B | 12/1987 |

OTHER PUBLICATIONS

International Search Report and Written Opinion for International Application No. PCT/US2019/040755, International Filing Date: Jul. 8, 2019; dated Oct. 22, 2019; 14 pages.

Kie et al., "Intelligent Control Heating, Ventilating and Air Conditioning Systems" International Conference on Computer Analysis of Images and Patterns, Nov. 2008, 8 pages.

* cited by examiner

CHILLER SYSTEM AND A METHOD FOR GENERATING COORDINATION MAPS FOR ENERGY EFFICIENT CHILLED WATER AND CONDENSER WATER TEMPERATURE RESETS IN CHILLER PLANT SYSTEM

The present disclosure relates generally to water chiller systems, and more specifically, to generating coordination maps for energy efficient chilled water and condenser water temperature setpoints in a chiller plant system.

Trim and response algorithms have been used in commercial HVAC systems and chiller plants to adjust setpoints based on cooling needs and reduce energy consumption when generating the cooled water and air for cooling various structures such as office buildings or industrial plants. The cooling needs of the buildings can depend on a number of factors including building size, occupancy, weather variations, and the like. Setpoints can be configured to manage the comfort for occupants or to regulate the conditions for the storage of goods or other applications. Setpoints calculated from trim and response algorithms are used to control the temperature of the various zones of an area.

BRIEF DESCRIPTION

According to one embodiment, a system for generating coordination maps for energy efficient chilled water and condenser water temperature resets in a chiller plant system is shown. The system includes a controller configured to control and set thresholds for one or more parameters of the chiller system, wherein the chiller system includes one or more cooling towers, one or more pumps, and a water chiller, and one or more sensors operably coupled to the controller, wherein the one or more sensors are configured to measure values for one or more parameters. The system also includes a processor coupled to the controller, wherein the processor is configured to generate a coordination map based on the measured values and the thresholds for the one or more parameters, configure an operating setpoint for the chiller system based on the coordination map, and control the chiller system based at least in part on the configured operating setpoint.

In addition to one or more of the features described above, or as an alternative, further embodiments may include an operating setpoint that is at least one of a chilled water supply temperature setpoint or a condenser water supply temperature setpoint.

In addition to one or more of the features described above, or as an alternative, further embodiments may include thresholds that include a maximum chilled water supply temperature and a minimum chilled water supply temperature.

In addition to one or more of the features described above, or as an alternative, further embodiments may include thresholds that include a maximum condenser water temperature and a minimum condenser water temperature.

In addition to one or more of the features described above, or as an alternative, further embodiments may include a controller that is operably coupled to the one or more sensors to receive feedback indicating at least one of a number of cooling requests from terminal actuator status such as a water valve position, damper position, or fan speed in air-water terminals and the controller is configured to adaptively adjust the setpoint based on the feedback.

In addition to one or more of the features described above, or as an alternative, further embodiments may include generating the coordination map including determining a load of the chiller system, determining chiller water temperature, and generating the coordination map based at least in part on the load and the chilled water temperature.

In addition to one or more of the features described above, or as an alternative, further embodiments may include generating the coordination map including determining ambient wet bulb temperature, determining condenser water temperature, and generating the coordination map based at least in part on the wet bulb temperature and the condenser water temperature.

In addition to one or more of the features described above, or as an alternative, further embodiments may include a wet bulb temperature that is determined using a temperature sensor and a humidity sensor.

According to one embodiment, a method for generating coordination maps for energy efficient chilled water and condenser water temperature resets in a chiller plant system is provided. The method includes setting thresholds for one or more parameters of a chiller system, monitoring a first set of sensors of the chiller system that measure values for the one or more parameters, and generating a coordination map based on the measured values for the one or more parameters. The method also includes configuring an operating setpoint for the chiller system based on the coordination map, and controlling the chiller system based at least in part on the configured operating setpoint.

In addition to one or more of the features described above, or as an alternative, further embodiments may include an operating setpoint that is at least one of a chilled water supply temperature setpoint or a condenser water supply temperature setpoint.

In addition to one or more of the features described above, or as an alternative, further embodiments may include thresholds that include a maximum chilled water supply temperature and a minimum chilled water supply temperature.

In addition to one or more of the features described above, or as an alternative, further embodiments may include thresholds that include a maximum condenser water temperature and a minimum condenser water temperature.

In addition to one or more of the features described above, or as an alternative, further embodiments may include adaptively adjusting the setpoint and coordination map based on feedback, wherein the feedback is based on at least one of a number of cooling requests from terminal actuator status such as a water valve position, damper position, or fan speed in air-water terminals.

In addition to one or more of the features described above, or as an alternative, further embodiments may include generating the coordination map including determining a load of the chiller system, determining chilled water temperature, and generating the coordination map based at least in part on the load and the chilled water temperature.

In addition to one or more of the features described above, or as an alternative, further embodiments may include generating the coordination map includes determining ambient wet bulb temperature, determining condenser water temperature, and generating the coordination map based at least in part on the wet bulb temperature and the condenser water temperature.

In addition to one or more of the features described above, or as an alternative, further embodiments may include using a wet bulb temperature that is determined using a temperature sensor and a humidity sensor.

BRIEF DESCRIPTION OF THE DRAWINGS

The following descriptions should not be considered limiting in any way. With reference to the accompanying drawings, like elements are numbered alike.

DETAILED DESCRIPTION

In today's environment, water chiller systems are used to manage the cooling temperature of one or more zones of a building. Responsive to cooling demands from one or more zones, the chilled water flow rate supplied to the air-water terminals can be adapted to achieve the desired temperature in the zone, by controlling a status of a terminal actuator such as the valve opening. Other techniques can include adapting the air supplied by the air-water terminals located in the one or more zones, by controlling the terminal actuator status such as the damper opening or fans speed. Controlling the chilled water temperature supplied from the chiller to the air-water terminal can also aid in meeting the cooling demands in the zones. Given the fact that the increased chilled water supply temperature can increase chiller efficiency for energy savings, trim and response algorithms have been used in commercial HVAC systems and chiller plants to adjust chiller chilled water supply temperature setpoint based on cooling requests.

However, upon receiving cooling requests from one or more zones, there can be delay between reducing the temperature in the respective zone leading to discomfort to the occupant. In addition, in order to reduce the energy consumption of the water chiller system, complex algorithms and/or great tuning efforts are required to manage the setpoints configured for each zone.

The techniques described herein reduce the calculations of the complex real-time based control optimization algorithms by correlating the operation of the chilled water system to the trends of the complex algorithms, leading to less tuning efforts in deployment. The techniques leverage the relationship between water side loads and chilled water supply temperature setpoints. The techniques also leverage the relationship between the ambient wet bulb temperatures and condenser water temperature setpoints to manage the cooling of the building. The techniques achieve similar performance as the complex control algorithms without the increased computations performed by those systems.

Figure 1:
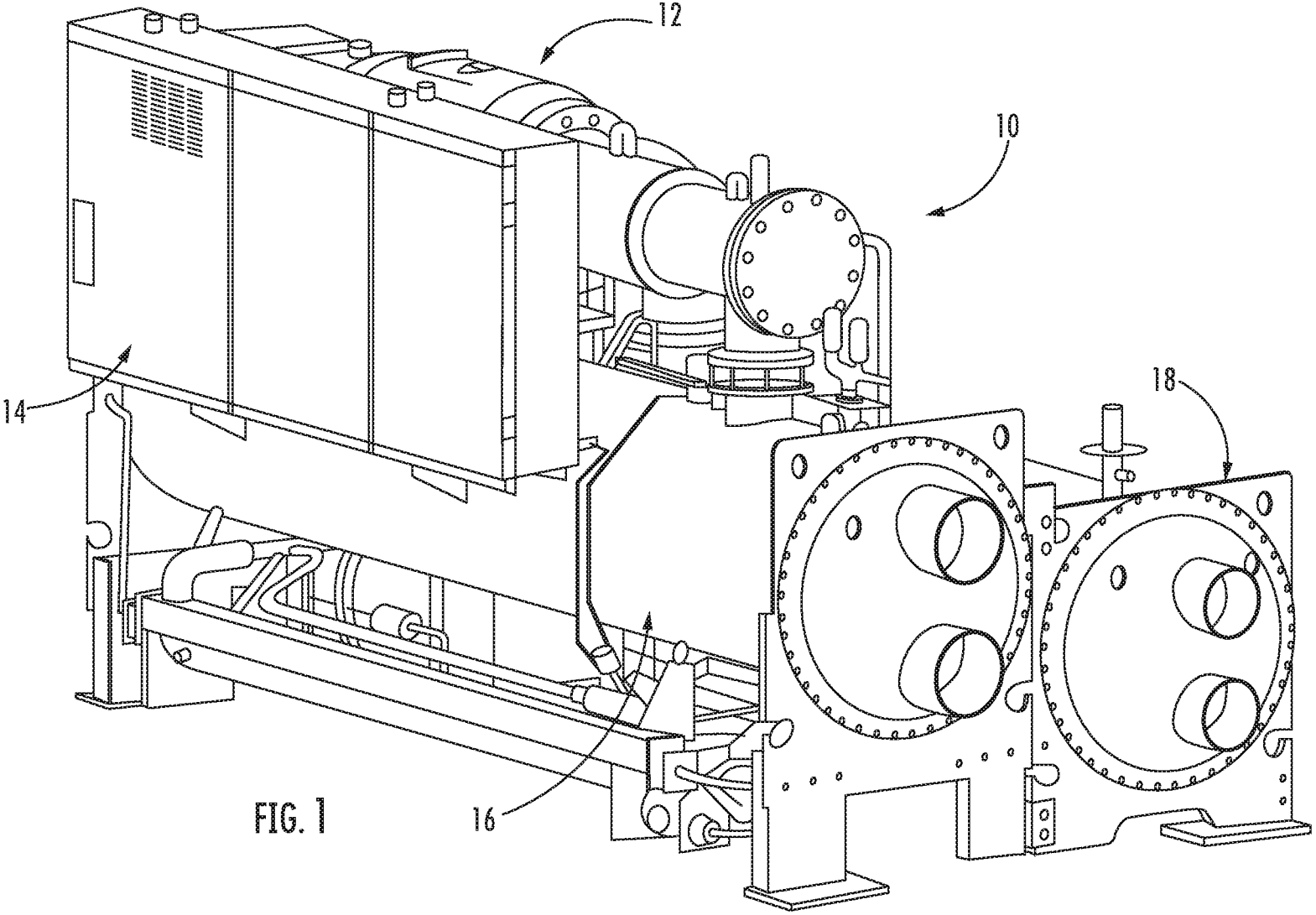
FIG. 1 is a perspective view of a chiller system in an accordance with one or more embodiments.

FIG. 1 depicts a chiller 10 in accordance with one or more embodiments. Chiller 10 is a screw chiller, but embodiments are appropriate for use with other compression chiller assemblies, such as, for example, a centrifugal chiller. As shown in FIG. 1, chiller 10 includes compressor 12, variable frequency drive 14, condenser 16 and cooler 18. It is to be understood the techniques described herein can apply to other types of chillers such as fixed speed chillers and is not limited to variable speed chillers.

In operation, gaseous refrigerant is induced into compressor 12 and compressed. Compressor 12 is driven by a motor under the control of variable frequency drive 14. Variable frequency drive 14 controls the frequency of the alternating current (AC) supplied to the motor thereby controlling the speed of the motor and the output of compressor 12. After the refrigerant is compressed, the high temperature, high pressure refrigerant gas is supplied to condenser 16. In condenser 16, the gaseous refrigerant condenses into liquid as it gives up heat. The condensed liquid refrigerant then flows into cooler 18, which circulates chiller water. The low pressure environment in cooler 18 causes the refrigerant to change states to a gas and, as it does so, it absorbs the required heat of vaporization from the chiller water, thus reducing the temperature of the water. The low pressure vapor is then drawn into the inlet of compressor 12 and the cycle is continually repeated. The chiller water is circulated through a distribution system to cooling coils for, for example, comfort air conditioning.

Figure 2:
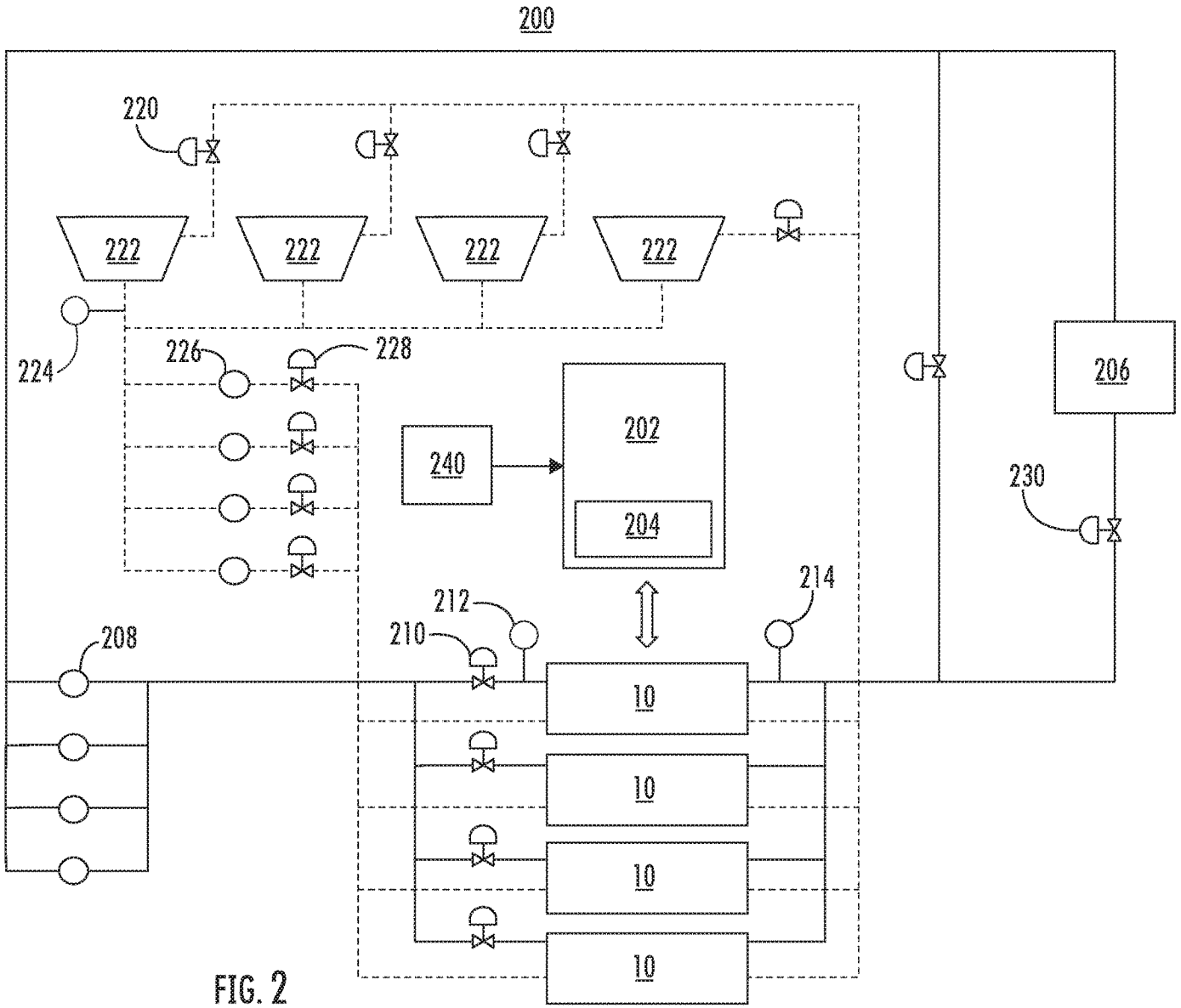
FIG. 2 depicts another perspective view of a chiller system in accordance with one or more embodiments.

Referring now to FIG. 2, a chiller system 200 in accordance with one or more embodiments is shown. In one or more embodiments, the chiller system 200 includes the chiller 10 shown in FIG. 1. FIG. 2 depicts a controller 202 that includes a processor 204 and is operably coupled to the chiller 10 and other components in the system 200. The controller 202 is configured to control various processes of the system 200 including setpoints, valves, motors, pumps, etc. The chiller 10 is connected to the load 206 which includes one or more air-water terminals that use the chiller water for cooling different zones of the load. The actuators 230 in the air-water terminals located at the load are controlled based on comfort feedback in load 206, by using, for example, water valves that are configured to control the flow rate of water from the chiller 10 to the coils, fans, or dampers that are configured to control the air flow rate from the air-water terminals to the load. The controller 202 is configured to detect the actuator's 230 position using one or more sensors (not shown).

As the water exits the load 206, the water is pumped back into the chiller 10 using one or more chilled water pumps 208. The flow rate of water entering the chiller 10 can be controlled by the valve 210. The temperature of the water being input into the chiller 10 can be measured by sensor 212 and the output temperature can be measured by the sensor 214. Multiple sensors 212 and 214 can be respectively coupled to the inlet and outlet of each chiller 10, although only one pair of sensors is shown.

The condenser 16 is configured to remove the heat from the water used to provide cooling at the load 206. After leaving the chiller 10, the water is sent to the cooling tower 222 to remove heat. The flow rate of the water to the cooling tower 222 can be controlled by the valve 220. Upon exiting the cooling tower 222, the water enters the condenser pumps 226 and is pumped back to the chiller 10. The condenser water temperature can be measured at the exit of the cooling tower 222 by a sensor 224. Each outlet of the cooling towers 222 can include individual sensors to communicate the condenser entering water temperature to the controller 202. In addition, the controller 202 is configured to receive the wet bulb air temperature using sensor 240. In other embodiments, the wet bulb air temperature can be calculated using a temperature sensor and a humidity sensor (not shown but can be incorporated in the sensor 240). In another embodiment, the wet bulb temperature can be received from another system over a network, instead of using the local sensors to determine the wet bulb temperature.

The processor 204 is configured to receive data to generate a coordination map in accordance with one or more embodiments. The temperature measurements, setpoint data, load information, cooling requests, etc. are used to approximate the maps to obtain efficient chiller performance as discussed below.

Figure 3:
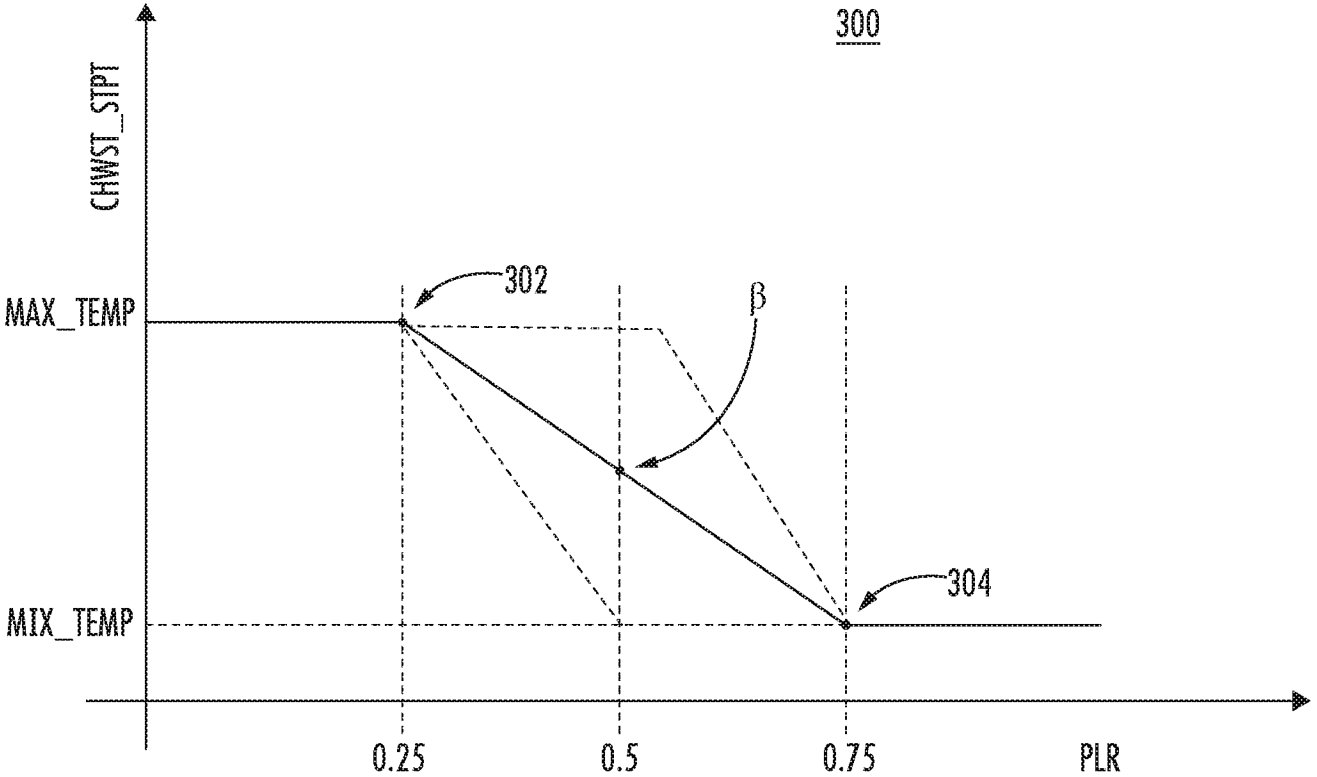
FIG. 3 depicts a chilled water supply temperature map in accordance with one or more embodiments.

Now referring to FIG. 3, a chilled water supply temperature setpoint map 300 in accordance with one or more embodiments is shown. As shown in the map 300, the x-axis provides the partial load ratio (PLR) which indicates the proportion of the cooling capacity being provided by the chiller system 200 over its maximum capability. The y-axis of the map 300 illustrates the temperature of the chiller water (CHWST) setpoint of the chiller 10. The maximum temperature (Max_temp) and minimum temperature (Min_temp) can be defined by a specification for the chiller system 200. In other embodiments, the maximum and minimum temperatures can be configured by an operator. It should be noted that FIG. 3 is a non-limiting example, where the values 0.25, 0.5, 0.75 at x-axis can be selected to be different values.

The PLR of the map 300 is used to determine the proportion of the cooling capacity at which the chiller system 200 is operating. The PLR is a ratio where a ratio being equal to 1 indicates the chiller system 200 is operating at a maximum capacity where the load requires elevated amounts of cooling. However, a PLR ratio of 0.25 indicates the chiller system 200 is operating at 25% of its maximum capability. Responsive to measuring the temperature of the water in the water loop of the chiller system 200, an indication of how much cooling is required by a building can be determined.

When the PLR indicates that there is a low load such as 0.25, the chilled water temperature can run at higher temperatures, without sacrificing the occupant comfort as the terminal actuators have the capability to compensate for the impact. Therefore, a higher chilled water supply temperature can be set for the lower loads. On the other hand, if the PLR indicates a higher load such as 0.75, the chilled water supply temperature can be reduced to a lower temperature to avoid saturation of terminal actuators to achieve the desired cooling. Therefore, a lower chilled water supply temperature setpoint can be set for the higher loads. In one or more embodiments, the curve between the maximum and minimum chilled water supply temperatures, at points 302 and 304, respectively, can be approximated which reduces the amount of complex calculations while receiving similar performance as the optimized control systems.

The PLR can be calculated by Equation 1 provided below:

$$\text{PLR}=\text{ChillerCapcity}/\text{RatedChillerCapacity} \quad \text{(Eq. 1)}$$

wherein ChillerCapcity is the total cooling capacity being provided by the chiller system 200; and RatedChillerCapacity is the total rated cooling capacity that the chiller system 200 is able to provide at maximum operation. In other embodiments, a system having a more than one chiller, the ChillerCapcity is the total cooling capacity being provided by all of the chillers, and the RatedChillerCapacity is the sum of all of the chillers' rated capacity.

In a scenario where the chilled water flow sensors of the chiller are available, the ChillerCapcity can be calculated according to the following Equation 2:

$$\text{ChillerCapcity}=\text{ChilledWaterFlow}*cp*(T_{input}-T_{output}) \quad \text{(Eq. 2)}$$

wherein $T_{input}$ is the temperature of the chilled water input into the chiller; $T_{output}$ is the temperature of the chilled water output of the chiller; ChilledWaterFlow is the mass flow rate of the chilled water to the terminal building; and cp is the specific heat capacity of water. In other embodiments, a system having a more than one chiller, the ChilledWaterFlow is the total chilled water flow into all of the chillers.

In a different scenario where the chilled water flow sensors are unavailable, the ChillerCapcity can be estimated based on cooling capacity estimation for each running chiller using the available refrigerant loop variables measured from the chiller local controller performing the chiller operation, according to the equations shown below.

First, the refrigerant flow rate through the compressor can be estimated using the following Equation 3:

$$\text{IP}\times\eta_{motor}=q_m\times(h_2-h_1) \quad \text{(Eq. 3)}$$

wherein IP is input power of motor measured from the motor coupled to the chiller using current and voltage, or the power can be measured directly with a power meter; $\eta_{motor}$ is motor efficiency provided by manufacturer; $q_m$ is refrigerant flow rate; $h_2$ is compressor outlet enthalpy; $h_1$ is compressor inlet enthalpy.

Next, the chiller capacity is estimated by the following Equations 4 and 5:

$$q_0=q_m\times(h_1-h_5) \quad \text{(Eq. 4)}$$

$$Q=q_0-\text{IP}\times(1-\eta_{motor}) \quad \text{(Eq. 5)}$$

where $q_m$ is refrigerant flow rate; $h_1$ is evaporator outlet enthalpy; $h_5$ is evaporator inlet enthalpy; IP—input power of motor; Q—chiller capacity.

Finally, the total cooling capacity provided by the chiller system is estimated based on the following Equation 6:

$$\text{ChillerCapcity}=\text{Sum of } Q \text{ for all running chillers} \quad \text{(Eq. 6)}$$

As the water chiller system 200 operates over time and the load varies, the PLR data is collected and used for calculation of the chilled water supply temperature setpoint based on the map 300 to be provided to the chiller 10 local controller (not shown).

In other embodiments, the data including the PLR and the chilled water supply temperature are collected and used to approximate the curve shown in FIG. 3. The curve shown in FIG. 3 is learned over time which correlates the chilled water supply temperature setpoint with the PLR to operate the chiller to achieve the desired comfort performance in building. When determining the curve shown in FIG. 3, the map has one or more adjustable β points corresponding to one or more chilled water supply temperature setpoints in one or more fixed intermediate PLRs. In other embodiments, the β point corresponds to chilled water supply temperature setpoint at current measured PLR. If it is determined that the current chilled water temperature setpoint according to the current map does not achieve the desired comfort performance in building based on feedback from load, the approximated curve through the one or more β points can be adaptively modified.

For example, feedback can include information on the position of an actuator 230 that controls the flow of the chilled water or flow of air through the air-water terminals. The actuator's 230 position is correlated to the cooling capacity of the building where the feedback can indicate the chilled water supply temperature is too high and unable to meet the load's cooling needs, or the feedback can indicate it has the ability to increase the chilled water supply temperature to increase the chiller efficiency while still being able to meet the load's cooling needs. In the event the actuator's 230 position is 100% open, it indicates that the desired cooling in the zone may not be achieved and the chiller needs to deliver lower chilled water temperature. On the other hand, if the actuator's 230 position is partially open such as 25% open, it indicates that the terminal actuators have the capability to increase its position if the chilled water temperature is increased.

In the event the cooling needs of the load are not being met, the chilled water supply temperature setpoint at the one or more points β can be modified (lowered), to decrease the temperature of the chilled water supply which increases the cooling capacity of the system. In a non-limiting example, the modification is based on determining the performance of the chiller by comparing the setpoints to the actual operating temperatures and conditions. The one or more points β can be adapted by a configurable incremental value and the performance of the chiller system can be periodically checked to automatically adapt the one or more points β. Other types of feedback can be utilized to adapt the curve that is approximated through one or more points β which can include a number of received cooling requests from actuators status. In one or more embodiments, the performance data of the chiller system, such feedback comparing the setpoint temperature to the actual chilled water supply temperature or condenser water supply temperature, can be received in real-time during chiller operation and can be used to adjust the one or more points β shown in the map 300.

Figure 4:
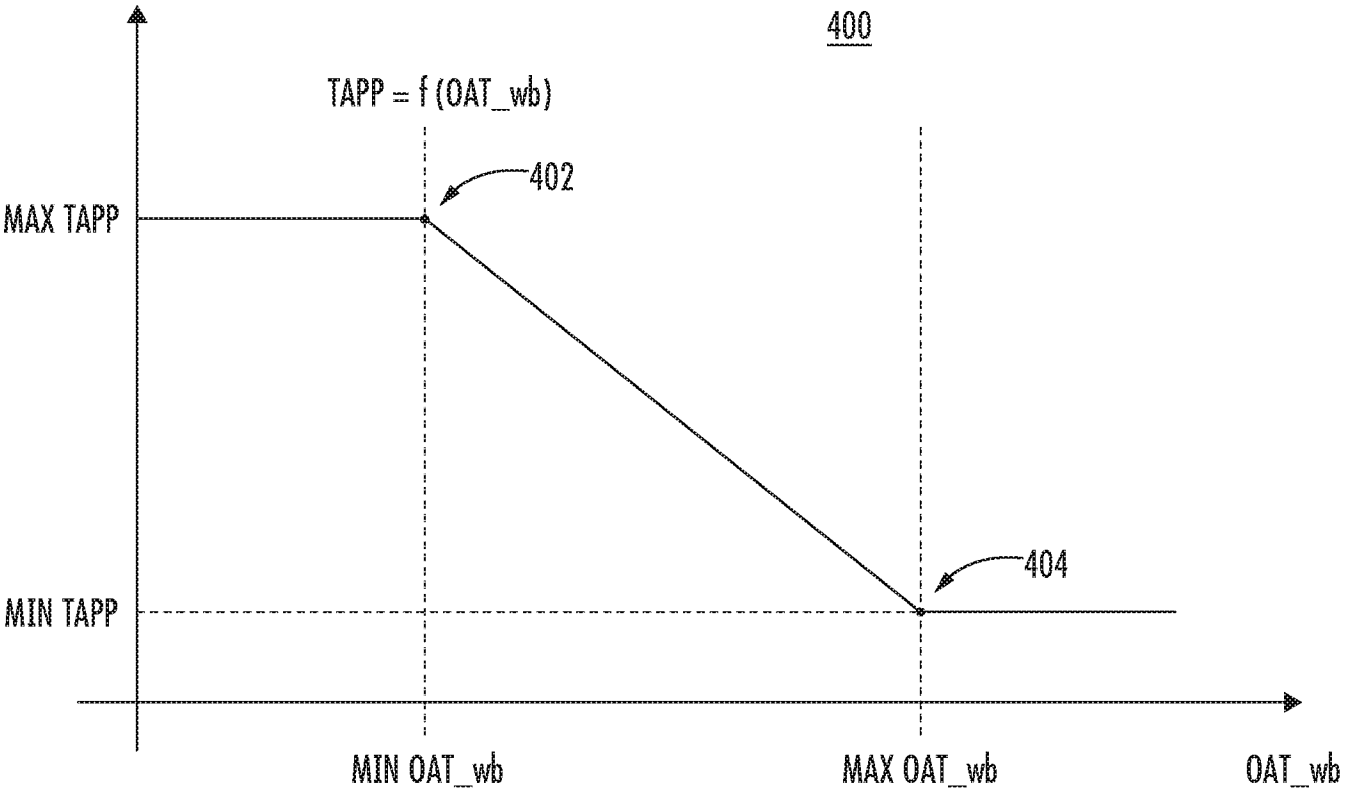
FIG. 4 depicts a condenser water supply temperature map in accordance with one or more embodiments.

Now referring to FIG. 4, a condenser water supply temperature setpoint map 400 in accordance with one or more embodiments is shown. The x-axis provides the ambient wet bulb air temperature (OAT_wb) and the y-axis provides the approach temperature (Tapp), which is the difference between the condenser temperature setpoint minus and the ambient wet bulb air temperature (OAT_wb). In one or more embodiments the approach temperature is a function of the ambient wet bulb temperature.

The maximum approach temperature (Max Tapp) is correlated to the minimum ambient wet bulb temperature (Min OAT_wb). The cooler the ambient wet bulb temperature the warmer the condenser water supply temperature can be to achieve the desired cooling results while minimizing the energy of the entire chiller system 200 including chillers, pumps and cooling tower fans. On the other hand, when the ambient wet bulb temperature is at a maximum temperature (Max OAT_wb), the approach temperature should be set to the minimum allowed temperature (Min Tapp) to minimize the energy of the chiller system 200. The minimum and maximum ambient wet bulb temperature can be observed over a time period and used to approximate the curve over the points 402 and 404. The time period is a configurable time period and can range from hours to months to years, etc. The curve between these two points is approximated and is used to adjust the condenser water supply temperature setpoint accordingly.

In one or more embodiments, safe chiller operation is achieved by setting limits where condenser water supply temperatures (CWST) are limited by CWST_stpt≥Min CWST_stpt; and (CWST_stpt−CHWST_stpt)≥min lift.

The Max Tapp is based on a ratio of rated (cooling tower) CT and chiller power. The Min CWST_stpt is the minimum allowed condenser water supply temperature that is determined by the chiller specification. The Min lift is the value required to avoid any operational issues associated with oil returns in the chillers. Upon reaching the condenser water supply temperature setpoint, the chiller system 200 is operated to regulate the condenser water supply temperature by controlling the cooling tower operation.

In one or more embodiments, the setpoints for the chilled water supply temperature and the condenser water supply temperature are configured to operate the chiller system 200 independently of each other. In a different embodiment, one setpoint can be given priority over the other setpoint and vice versa.

Figure 5:
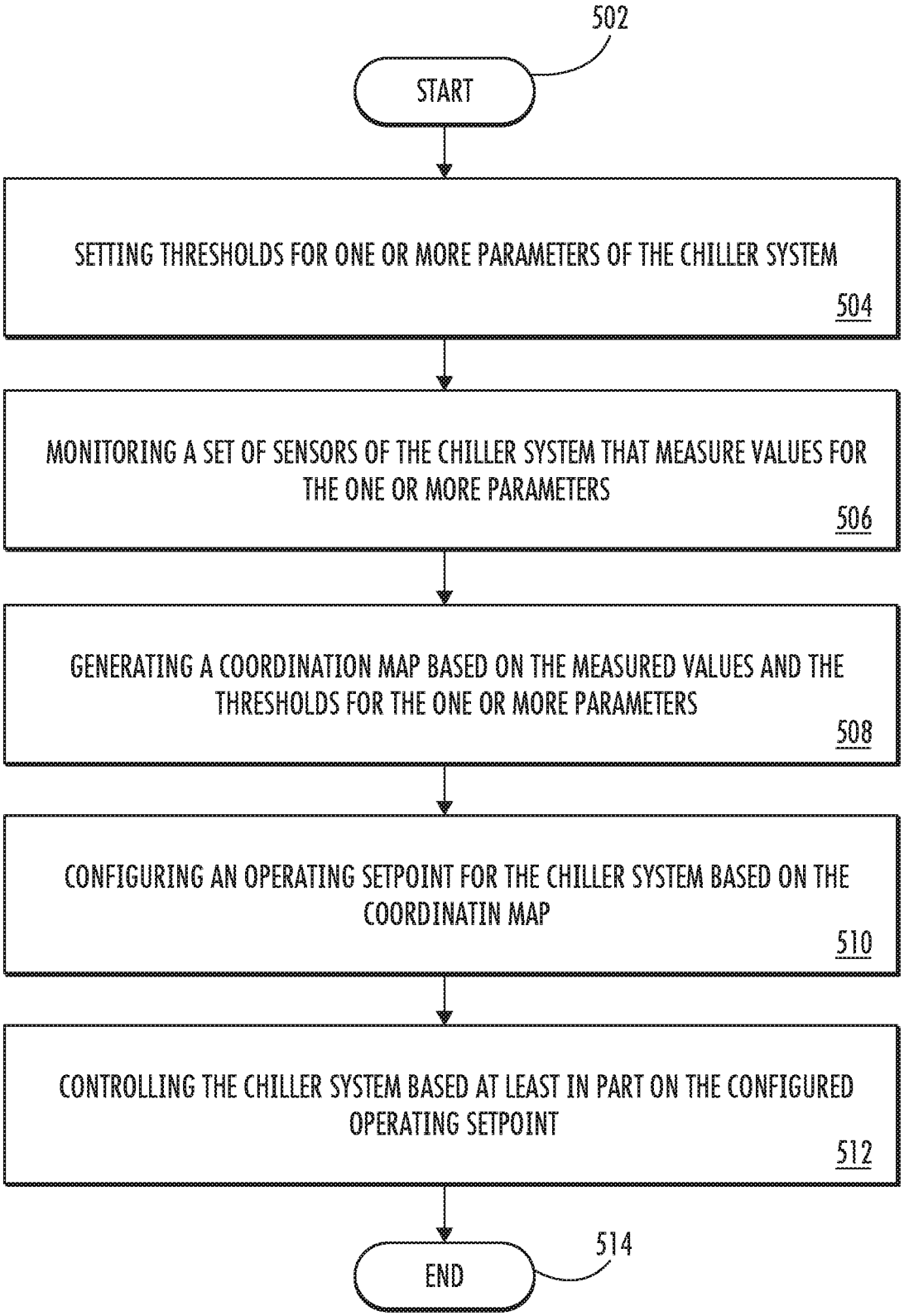
FIG. 5 depicts a flowchart of a method for generating coordination maps for energy efficient chiller water and condenser water temperature resets in a chiller plant system in accordance with one or more embodiments.

Referring now to FIG. 5, a method 500 for generating coordination maps in accordance with one or more embodiments is shown.

The method 500 can be implemented in the systems of FIG. 1 and FIG. 2 or other chiller configurations. The method 500 begins at block 502 and continues to block 504 which provides for setting thresholds for one or more parameters of the chiller system. The parameters can include the chilled water supply temperature, condenser water supply temperature, ambient wet bulb temperature, load information, etc. The thresholds for the parameters can include maximum and minimum limits for the chilled water supply temperature. In addition, other thresholds for parameters can be used to operate the chiller system. The thresholds can be determined by the specification for the chiller system.

The method 500 proceeds to block 506 and includes monitoring a set of sensor of the chiller system that measure values for the one or one more parameters. The sensors can include flow meters, temperature sensors, humidity sensors, etc. to collect data to perform the approximations for configuring the setpoints.

At block 508, the method 500 provides for generating a coordination map based on the measured values and the threshold for the one or more parameters. The generation maps, as shown in FIGS. 3 and 4, are generated using the maximum and minimum threshold limits and monitoring the performance of the system over a period of time to approximate the behavior of the chiller system between the maximum and minimum threshold limits.

The method 500, at block 510, provides for configuring a setpoint for the chiller system based on the coordination map. In one embodiment the setpoint is a chilled water supply temperature setpoint. In another embodiment, the setpoint is a condenser water supply temperature setpoint. The setpoint can be selected from the approximated curve of the coordination map based on the desired performance. Responsive to configuring the setpoint, block 512 provides for controlling the chiller system based at least in part on the configured setpoint. The chiller system regulates the temperature of the respective zones in accordance with the setpoint selected from the coordination map. The method 500 ends at block 514. It should be understood the method 500 can be repeated to update the setpoints according to the current conditions.

These techniques lead to reduced energy consumption and replace conventional trim and response algorithms with output chiller water and condenser water temperature setpoints. Additionally, a reduction in the delay in reaching desired temperatures for the respective zones can be achieved leading to increased occupant comfort while conserving resources.

The technical effects and benefits achieve energy performance benefits such that of trim and response algorithms without tuning from cooling requests. The configuration and techniques provide energy savings and operational scalability. The potential to maximize scalability is due to the minimum plant knowledge required since the complex algorithms are reduced by approximated optimal setpoints to achieve comfort and energy savings of the tightly controlled complex control based systems. This leads to time and effort reduction in deployment.

A detailed description of one or more embodiments of the disclosed apparatus and method are presented herein by way of exemplification and not limitation with reference to the Figures.

The term "about" is intended to include the degree of error associated with measurement of the particular quantity based upon the equipment available at the time of filing the application.

The terminology used herein is for the purpose of describing particular embodiments only and is not intended to be limiting of the present disclosure. As used herein, the singular forms "a", "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, element components, and/or groups thereof.

While the present disclosure has been described with reference to an exemplary embodiment or embodiments, it will be understood by those skilled in the art that various changes may be made and equivalents may be substituted for elements thereof without departing from the scope of the present disclosure. In addition, many modifications may be made to adapt a particular situation or material to the teachings of the present disclosure without departing from the essential scope thereof. Therefore, it is intended that the present disclosure not be limited to the particular embodiment disclosed as the best mode contemplated for carrying out this present disclosure, but that the present disclosure will include all embodiments falling within the scope of the claims.

What is claimed is:

1. A chiller system comprising:

a controller configured to control and set thresholds for one or more parameters of the chiller system, wherein the chiller system includes one or more cooling towers, one or more pumps, and one or more water chillers;

one or more sensors operably coupled to the controller, wherein the one or more sensors are configured to measure values for one or more parameters; and a processor coupled to the controller, wherein the processor is configured to generate a coordination map based on the measured values and the thresholds for the one or more parameters, configure an operating setpoint for the chiller system based on the coordination map, and control the chiller system based at least in part on the configured operating setpoint;

the controller is operably coupled to the one or more sensors to receive feedback indicating at least one of a number of cooling requests and the controller is configured to adaptively adjust the setpoint and coordination map based on the feedback.

2. The system of claim 1, wherein the operating setpoint is at least one of a chilled water supply temperature setpoint or a condenser water supply temperature setpoint.

3. The system of claim 1, wherein the thresholds include a maximum chilled water supply temperature and a minimum chilled water supply temperature.

4. The system of claim 1, wherein the thresholds include a maximum condenser water temperature and a minimum condenser water temperature.

5. A chiller system comprising:

a controller configured to control and set thresholds for one or more parameters of the chiller system, wherein the chiller system includes one or more cooling towers, one or more pumps, and one or more water chillers;

one or more sensors operably coupled to the controller, wherein the one or more sensors are configured to measure values for one or more parameters; and a processor coupled to the controller, wherein the processor is configured to generate a coordination map based on the measured values and the thresholds for the one or more parameters, configure an operating setpoint for the chiller system based on the coordination map, and control the chiller system based at least in part on the configured operating setpoint;

wherein the processor is configured to generate the coordination map comprises:

determining a load of the chiller system;

determining a chiller water temperature at the one or more water chillers; and generating the coordination map based at least in part on the load and the chiller water temperature.

6. The method of claim 1, wherein the processor is configured to generate the coordination map comprises:

determining ambient wet bulb temperature;

determining condenser water temperature; and generating the coordination map based at least in part on the wet bulb temperature and the condenser water temperature.

7. The method of claim 6, wherein the wet bulb temperature is determined using a temperature and a humidity sensor.

8. A method for generating coordination maps for energy efficient chiller water and condenser water temperature resets in a chiller plant system, the method comprising:

setting thresholds for one or more parameters of a chiller system;

monitoring a first set of sensors of the chiller system that measure values for the one or more parameters; and generating a coordination map based on the measured values for the one or more parameters;

configuring an operating setpoint for the chiller system based on the coordination map; and controlling the chiller system based at least in part on the configured operating setpoint;

adaptively adjusting the setpoint based on feedback, wherein the feedback is based on at least one of a number of cooling requests.

9. The method of claim 8, wherein the operating setpoint is at least one of a chilled water supply temperature setpoint or a condenser water supply temperature setpoint.

10. The method of claim 8, wherein the thresholds include a maximum chilled water supply temperature and a minimum chilled water supply temperature.

11. The method of claim 8, wherein the thresholds include a maximum condenser water temperature and a minimum condenser water temperature.

12. A method for generating coordination maps for energy efficient chiller water and condenser water temperature resets in a chiller plant system, the method comprising:

setting thresholds for one or more parameters of a chiller system;

monitoring a first set of sensors of the chiller system that measure values for the one or more parameters; and generating a coordination map based on the measured values for the one or more parameters;

configuring an operating setpoint for the chiller system based on the coordination map; and controlling the chiller system based at least in part on the configured operating setpoint;

wherein generating the coordination map comprises:

determining a load of the chiller system;

determining a chilled water temperature at one or more water chillers; and generating the coordination map based at least in part on the load and the chilled water temperature.

13. The method of claim 8, wherein generating the coordination map comprises:

determining ambient wet bulb temperature;

determining condenser water temperature; and generating the coordination map based at least in part on the wet bulb temperature and the condenser water temperature.

14. The method of claim 13, wherein the wet bulb temperature is determined using a temperature and a humidity sensor.

* * * * *